US006612430B1

(12) United States Patent
Silvera

(10) Patent No.: US 6,612,430 B1
(45) Date of Patent: Sep. 2, 2003

(54) DISPLAY PANEL FOR SHOES

(75) Inventor: Albert J. Silvera, Manhattan Beach, CA (US)

(73) Assignee: Seychelles Imports LLC, Gardena, CA (US)

( * ) Notice: Subject to any disclaimer, the term of this patent is extended or adjusted under 35 U.S.C. 154(b) by 0 days.

(21) Appl. No.: 09/728,492

(22) Filed: Nov. 24, 2000

(51) Int. Cl.[7] ..... B65D 85/18
(52) U.S. Cl. ..... 206/294; 36/11.5
(58) Field of Search ..... 206/294, 278, 206/486, 490; 36/11.5–28, 29, 25 R, 9 R, 9 A, 9; 12/146 BR, 142 E, 142 XS, 142 S, 146 B

(56) References Cited

U.S. PATENT DOCUMENTS 46,051 A * 1/1865 Adamson ..... 69/21
3,978,596 A * 9/1976 Brown et al. ..... 12/142 S
4,624,060 A * 11/1986 Maxwell ..... 24/704.2
4,795,029 A * 1/1989 Campbell et al. ..... 206/278
4,823,962 A * 4/1989 Arias ..... 211/113
5,185,942 A * 2/1993 Decker ..... 36/1
5,737,853 A * 4/1998 Smejkal ..... 36/11.5
5,771,605 A * 6/1998 Safdie ..... 36/25 R

* cited by examiner

*Primary Examiner*—Lee Young
*Assistant Examiner*—Lien Ngo
(74) *Attorney, Agent, or Firm*—Mitchell Silberberg & Knupp LLP

(57) ABSTRACT

Provided is a display panel for displaying and/or storing shoes. The display panel includes a base board defined by a first side, a second side and a peripheral edge. The base board has a first cut in a shape of a sole of a left shoe and a second cut in a shape of a sole of a right shoe. An upper portion of a left shoe is attached to an area of the second side that is enclosed by the first cut, and an upper portion of a right shoe is attached to an area of the second side that is enclosed by the second cut.

45 Claims, 4 Drawing Sheets

DISPLAY PANEL FOR SHOES

BACKGROUND OF THE INVENTION

1. Field of the Invention

The present invention concerns a display panel for displaying and/or storing shoes.

2. Description of the Prior Art

Conventionally, shoes that are available for sale at a retail store are packaged in a cardboard box. This technique typically makes the shoes invisible to the consumer. As a result, the store frequently has to rely on a limited number of display models to attract the consumer's attention. Once the consumer has identified a style of shoe that interests him or her, the consumer or a store employee is then required to retrieve a box containing that style in the consumer's size. As can be readily appreciated, this technique generally is quite ineffective at prompting impulse purchases.

Another technique for selling shoes is to tie the shoes together and then simply place them on a store shelf or hang them on a display hook in the store. This technique has the advantage of putting most or all of the shoes in full view of the store's customers, thereby more effectively facilitating impulse purchases. However, because the shoes are displayed loosely according to this technique, a certain impression of cheapness is often created in the minds of the consumers.

What is needed, therefore, is a display technique that is both effective at prompting impulse purchases and at the same time interesting or attractive for the consumer to view.

SUMMARY OF THE INVENTION

The present invention addresses these needs by providing a shoe display panel that includes a base board from which the soles of a pair of shoes are cut. When such a display panel is hung in a retail store, the shoes can be in plain view of the customer. At the same time, because the packaging is so unique and interesting, the customer may be even more inclined to purchase the product.

Thus, in one aspect the invention is directed to a display panel for displaying and/or storing shoes. The display panel includes a base board defined by a first side, a second side and a peripheral edge. The base board has a first cut in a shape of a sole of a left shoe and a second cut in a shape of a sole of a right shoe. An upper portion of a left shoe is attached to an area of the second side that is enclosed by the first cut, and an upper portion of a right shoe is attached to an area of the second side that is enclosed by the second cut.

In another aspect, the invention is directed to a display panel for displaying and/or storing shoes. The display panel includes a base board defined by a first side, a second side and a peripheral edge. The base board has a first cutout hole in a shape of a sole of a left shoe and a second cutout hole in a shape of a sole of a right shoe. The display panel further includes a left shoe having a sole matching the first cutout hole, such that the sole of the left shoe fits snugly within the first cutout hole, and a right shoe having a sole matching the second cutout hole, such that the sole of the right shoe fits snugly within the second cutout hole.

By providing a base board from which the soles of a pair of shoes are cut, together with the shoes themselves, in the foregoing manner, the present invention can provide a unique display and packaging article. Moreover, the display panel according to the present invention often can be used for subsequent storage of the shoes.

In a more particularized aspect of the invention, a hole is provide in the base board for facilitating hanging or carrying of the panel. Alternatively, an open hook may be provided for similar purposes.

In a further particularized aspect, a strap is provided to attach the shoes to the base board. This aspect of the invention can prevent the shoes from getting separated from the base board during the retail selling process.

The foregoing summary is intended merely to provide a brief description of the general nature of the invention. A more complete understanding of the invention can be obtained by referring to the claims and the following detailed description of the preferred embodiments in connection with the accompanying figures.

DESCRIPTION OF THE PREFERRED EMBODIMENT(S)

Figure 1:
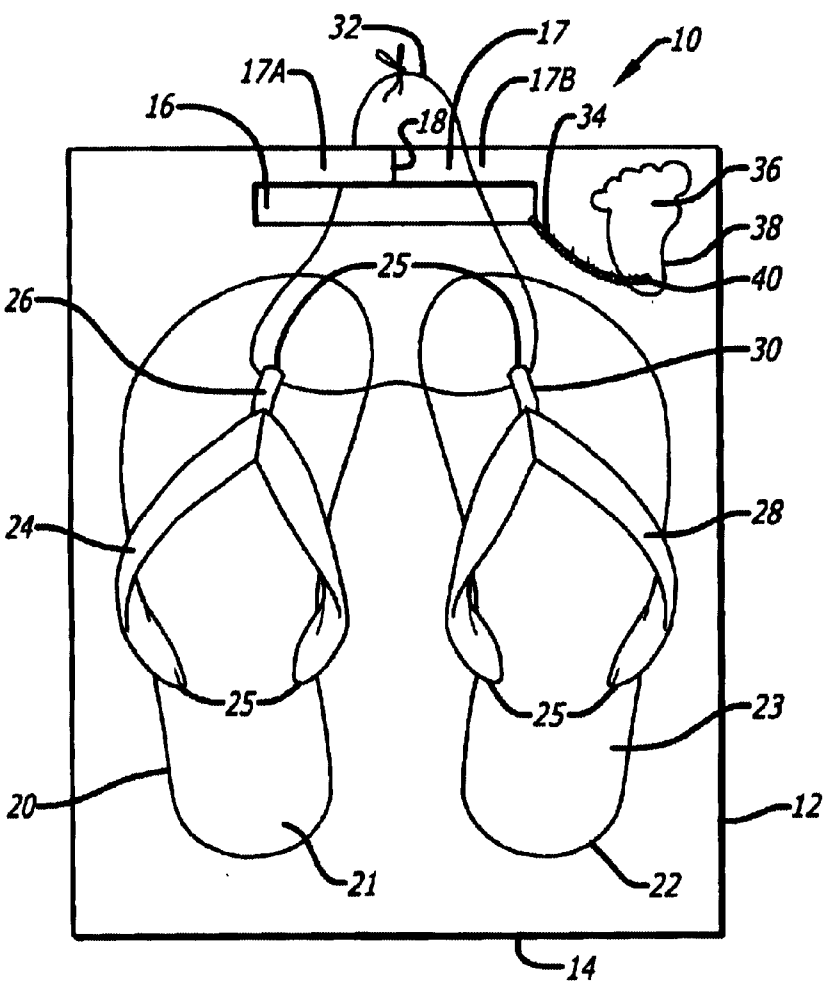
FIG. 1 illustrates a top plan view of a shoe display panel according to a first representative embodiment of the invention.

FIG. 1 illustrates a plan view of the top side 13 of a display panel 10 for storing and/or displaying shoes according to a representative embodiment of the present invention. Included in display panel 10 is a base board 12. In the present embodiment, the top side 13 of base board 12 has a smooth surface and is much smoother than the surface of bottom side 63 (shown in FIG. 2). However, it is also possible for top side 13 to have a raised or indented pattern. As shown in FIG. 1, the peripheral edge 14 of base board 12 has a rectangular shape in this embodiment of the invention. However, it should be understood that any other shape may instead be used.

Formed in display panel 10 is a cutout hole 16. In the present embodiment, cutout hole 16 is rectangular in shape, having dimensions of approximately 1 inch by 4.75 inches. This size and shape allows display panel 10 to be hung on a display hook or carried by hand, using cutout hole 16 and the portion 17 of base board 12 that is above cutout hole 16 as a handle. However, any other size and shape may instead be used. Preferably, cutout hole 16 is at least large enough to allow display panel 10 to be hung on most typical retail store display hooks or rods. Accordingly, the minimum dimension of cutout hole 16 preferably will be approximately ½ inch. As shown in FIG. 1, cutout hole 16 preferably is disposed close enough to peripheral edge 14 (e.g., an one-half inch away from peripheral edge 14) to form a comfortable and convenient handle and/or a hook for hanging purposes.

In addition, the portion 17 (which includes side portions 17A and 17B) of base board 12 that is disposed between cutout hole 16 and peripheral edge 14 may include a cut 18 through the entire thickness of base board 12. By providing such a cut 18, the two side portions 17A and 17B may be temporarily separated, allowing cutout hole 16 to accept a closed hook or a rod having ends that are inaccessible. Preferably, the material comprising base board 16 returns to its original shape when side portions 17A and 17B are released, thus allowing display panel 10 to be hung from such a closed hook or rod.

Base board 12 also is provided with cuts 20 and 22, enclosing sole-shaped cutouts 21 and 23, respectively. In particular, cut 20 is in the shape of the sole of a left shoe and cut 22 is in the shape of the sole of a right shoe. It is possible for these cuts to penetrate through the entire thickness of base board 12 over the entire perimeter of each such cut. However, in the preferred embodiment of the invention, at some or all points along the perimeter of each of cuts 20 and 22, the cuts do not penetrate all the way through base board 12. More preferably, just enough material is left adjoining sole-shaped cutouts 21 and 23 to the remainder of base board 12 to allow cutouts 21 and 23 to be popped out of base board 12 with slight to moderate effort.

Figure 2:
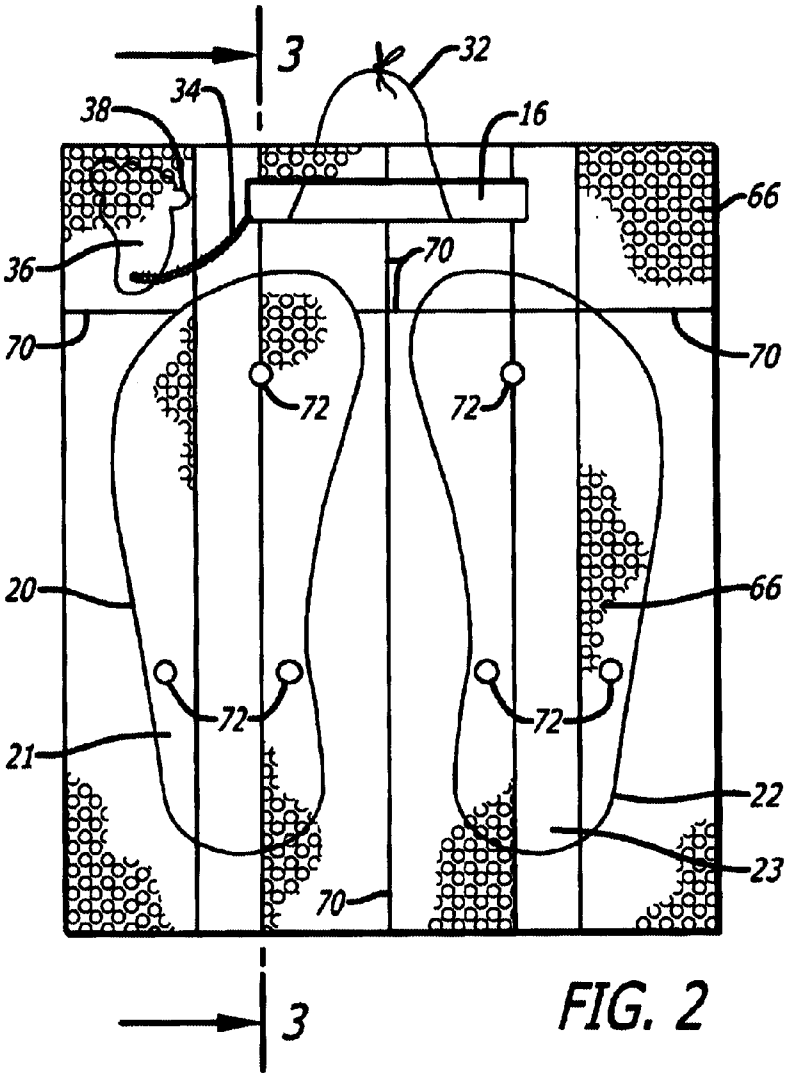
FIG. 2 illustrates a bottom plan view of a shoe display panel according to the first representative embodiment of the invention.

In this regard, the remaining material attaching cutouts 21 and 23 to the rest of base board 12 may be on the top side 13 of base board 12 or on the bottom side 63 (shown in FIG. 2). In certain embodiments, the remaining material may extend through the entire thickness of base board 12 at certain points along the perimeter of the cut, such as where cuts 20 and 22 are simply perforations. Preferably, in embodiments where base board material is left to attach cutouts 21 and 23, the location and amount of such material will be determined based on various considerations, such as the type of the material, the desired difficulty of separating the cutout pieces from the remainder of the base board, and the desired appearance of the cutout pieces after separating them.

Attached to cutouts 21 and 23 are the upper portions of a left shoe and a right shoe, respectively. In the present embodiment, the shoe is a thong sandal. Accordingly, the upper portion of the left shoe simply includes V-shaped strap 24 and a toe segment 26. Similarly, the upper portion of the right shoe only includes plastic V-shaped strap 28 and plastic toe segment 30. The end portions of each of the V-shaped straps 24 and 28 and toe segments 26 and 30 extend into holes 25 and through base board 12, allowing such V-shaped straps and toe segments to be securely attached to cutout portions 21 and 23, as discussed in more detail below.

It should be noted that any other type of shoe upper portion may instead be disposed on the sole-shaped cutout portions 21 and 23. Such alternative upper portions may be formed from any conventional material for upper portions of shoes (e.g., leather, vinyl, plastic, synthetic rubber or nylon). Similarly, such upper portions may be attached to sole-shaped cutouts 21 and 23 in any other manner that upper portions of shoes conventionally are attached to shoe soles, such as by stitching, gluing or a combination of stitching and gluing.

Each cutout sole together with its corresponding upper portion forms a shoe Thus, cutout sole 21 and its attached upper structure form a left shoe and cutout sole 23 and its attached upper structure form a right shoe.

A strap 32 also is provided and attaches one or both of the shoes to base board 12. In the present embodiment, strap 32 is provided as a loop of string or plastic that attaches to the shoes by looping through the upper portion of each shoe and also attaches to base board 12 by looping through cutout hole 16 and around section 17. However, strap 32 may instead attach to any other portion of the shoes and to any other portion of the remainder of base board 12.

Additional articles also may be provided in display panel 10. For example, in the present embodiment of the invention, a key chain 34 is provided, together with a key-chain ornament 36. Similar to the shoe soles 21 and 23, the key-chain ornament is cut from base board 12. Again, similar to the shoe soles 21 and 23, the cut 38 defining ornament 36 may fully penetrate base board 12 along the entire perimeter of cut 38 so that ornament 36 simply fits snugly within the cutout hole 38. However, in the preferred embodiment, at least some of the, material is left to attach ornament 36 to the remainder of base board 12. The options for making cut 38 are the same as those for sole-shaped cuts 20 and 22 described above.

Provided in ornament 36 is a small hole 40 through which key chain 34 is fed. As shown in FIG. 1, key chain 34 also loops through cutout hole 16, thereby further attaching key chain 34 and key-chain ornament 36 to the remainder of base board 12.

FIG. 2 shows the bottom side 63 of display panel 10. Although cuts 20, 22 and 38 are shown in both FIGS. 1 and 2 as being continuous around their entire perimeter, it should be understood that this will, not always be the case. In fact, in a preferred embodiment of the invention in which cuts are made from the top side 13 downward, each cut either will not extend at all, or will extend only at certain segments along the cut's perimeter, to bottom side 63 of base board 12. Similarly, in an alternate preferred embodiment of the invention in which cuts are made from the bottom side 63 upward, each cut either will not extend at all, or will extend only at certain segments along the cut's perimeter, to the top side 13. This aspect of the invention is described in more detail below.

In the preferred embodiment of the invention, bottom side 63 has a raised and/or an indented pattern on it. Thus, in the embodiment shown in FIG. 2, raised circular bumps 66 are provided on bottom side 63 of base board 12. Any other raised decorative patterns may also be provided on the bottom side 63. However, it should be noted that it is also possible to manufacture base board 12 with a smooth bottom surface.

Also provided on bottom side 63 are various cuts 70. Preferably cuts 70 extend through only a fraction of the thickness of base board 12. For example, in the event that base board 12 includes different layers of material, cuts 70 preferably only extend through the bottommost layers.

Figure 3:
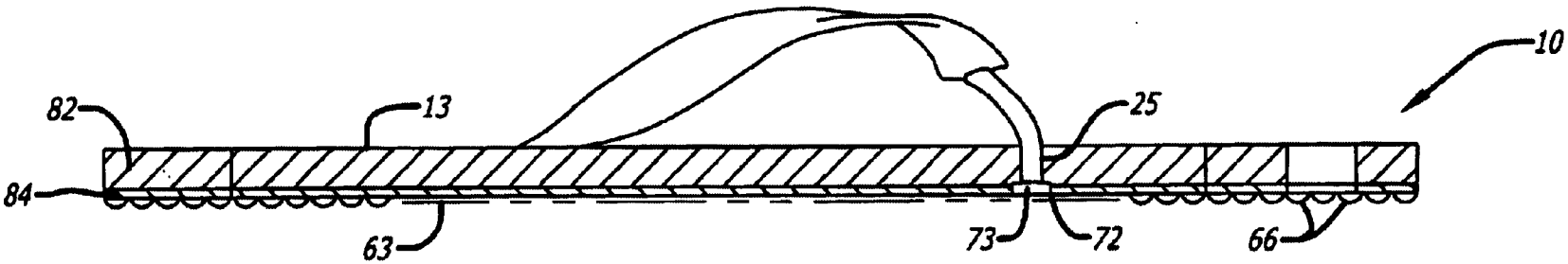
FIG. 3 illustrates a cross-sectional view of a shoe display panel according to the first representative embodiment of the invention.

A cross section of display panel 10 according to the current embodiment of the invention is shown in FIG. 3. In this embodiment, base board 12 includes only two layers, layer 82 which extends to the top side 13 of base board 12 and layer 84 which extends to bottom side 63.

In the present embodiment of the invention, cuts 70 extend only through layer 84. However, it is also possible to extend cuts 70 through a portion of the top layer 82. Also, although it is possible to instead make cuts 70 downwardly from the top side 13, it ordinarily will be preferable to cut through the strongest portion of baseboard 12 in making cuts 70. Because layer 84 is at the bottom of the shoe's sole, it generally must be strong and dense enough to protect the wearer's foot from sharp or rough objects on the ground, while layer 82 generally will be softer and more cushiony in order to make the shoe comfortable. Therefore, cuts 70 preferably will be made from bottom side 63 and will extend entirely through layer 84. By providing cuts 70 in this manner, base board 12 may be flexed more easily, thereby facilitating the ability of the consumer or user to pop the shoes and any other items (e.g., key chain ornament 36) out of base board 12. As shown in FIG. 2, cuts 70 are made horizontally and vertically in the present embodiment. However, any other configuration of cuts that facilitate such flexing may instead be used.

Circular holes 72 are provided on the bottom side 63, directly adjacent to holes 25 in top side 13. Disposed within circular holes 72 are the circular tabs 73 that anchor the upper portion of the shoe to the sole. This structure is illustrated in FIG. 3 and is well known in the art.

Figure 4:
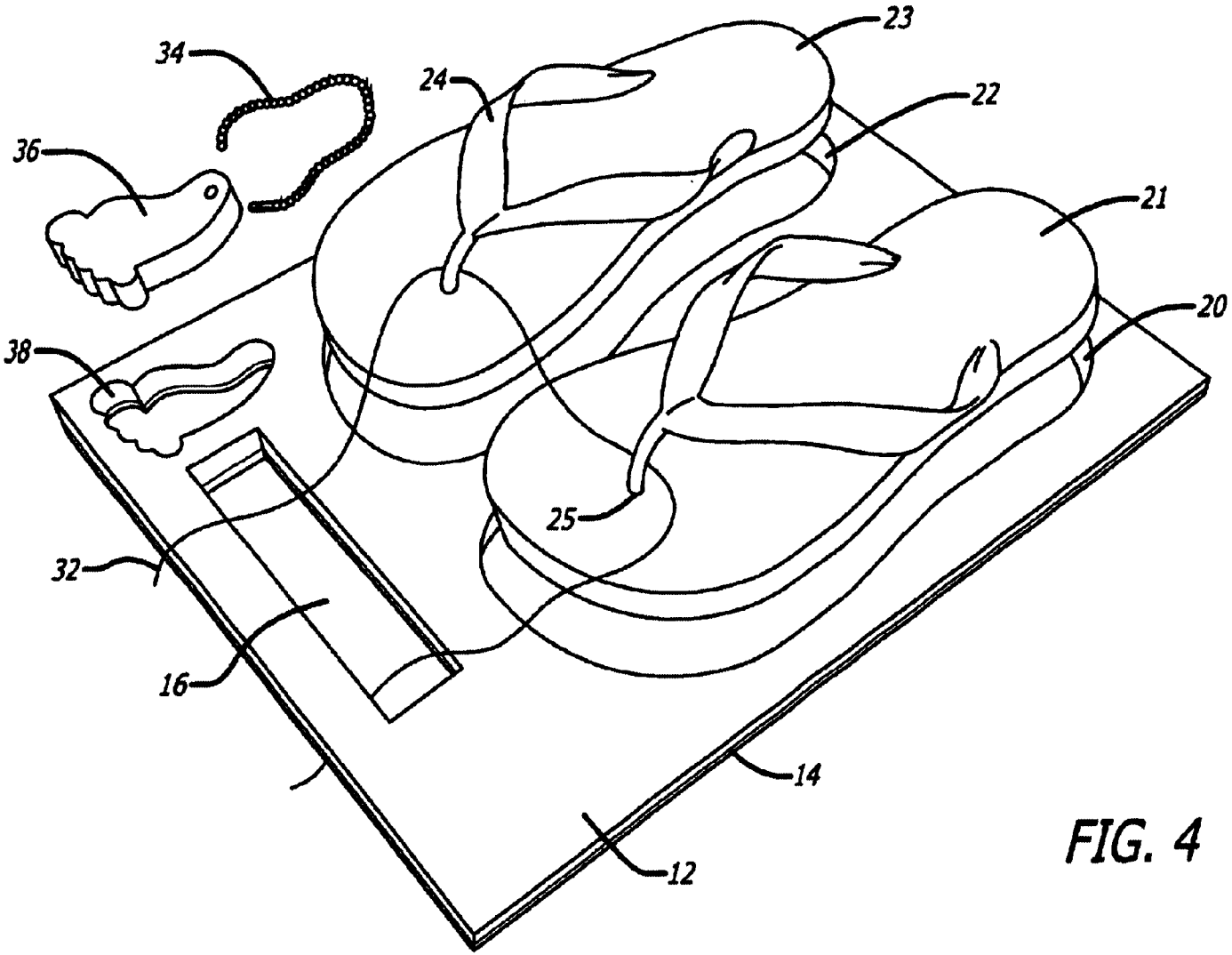
FIG. 4 illustrates a top perspective exploded view of a shoe display panel according to the first representative embodiment of the invention.

Upon flexing base board 12 and pushing cutouts 21 and 23, such cutouts can be separated from the remainder of base board 12, effectively popping out the corresponding shoes. Generally speaking, the ease with which the shoes can be removed from base board 12 will depend upon the amount of material still attaching cutouts 21 and 23 to base board 12, if any, after cuts 20 and 22 have been made, as well as the strength of such remaining material. In a similar manner, key-chain ornament 36 can be popped out from base board 12, subject to the same considerations. FIG. 4 illustrates a top perspective view of display panel 10 after the shoes and key-chain ornament have been popped out.

Once these items have been initially removed from base board 12, it generally will be possible to push them back into their corresponding cutout holes. This can often allow for easy subsequent storage of such items, allowing the shoes to be hung from a hook or a rod, for example.

The processes used to manufacture display panel 10 will now be discussed in more detail. Such process will generally depend upon a number of different factors, such as the types of materials to be used, the desired quality of the end product, the target production costs, and the state of the technology at the time of production. Thus, although the following discussion pertains to a manufacturing process that may be used in a representative embodiment of the present invention, it should be understood that this embodiment is merely exemplary and is not intended to be limiting.

In the present embodiment, base board 12 is comprised of two layers of ethylene vinyl acetate (EVA), with layer 84 being denser and stronger than layer 82. However, it should be understood that: base board 12 may be formed from three or more layers, different layers may be comprised of different materials, and any other arrangement of material may instead be used.

Each of layers 82 and 84 can be obtained in large sheets. Holes 25 are punched into the less dense EVA sheet in alignment with where the shoes are to be located and layer holes 72 are punched into the denser EVA sheet, also in alignment with where the shoes are to be located. Thereafter, the two sheets are bonded together using any conventional cement used for this purpose, and any patterns desired on the top side 13 or the bottom side 63 are pressed into the corresponding EVA.

Upon completion of the bonding process, the cuts are made, preferably using a clicker machine. In the preferred embodiment, most of the cuts will be made from top side 13, although some of the cuts (e.g., cuts 70) preferably also are simultaneously made from bottom side 63. As noted above, cuts 20, 22 and 38 may fully penetrate the entire thickness of base board 12. Alternatively, by appropriately adjusting the clicker machine, any or all of such cuts may only partially penetrate base board 12.

Similarly, by designing the die edge appropriately, any or all of such cuts may be perforated, penetrating fully along certain portions of the perimeter and less than fully along others, thereby leaving material only intermittently along the perimeter. Specifically, such an edge would be deeper in certain portions (e.g., where the cut is to penetrate all the way through) and less deep in others (e.g., where some portion of the material is to remain.

Also, in the event that any cut penetrates fully along the entire perimeter, the corresponding cutout portion may simply be held in the resulting cutout hole by the expansion forces of the material. Alternatively, adhesive (e.g., glue or cement) may be used to hold the cutout pieces in place when such cuts are to be used. In this latter case, adhesive may be used around the entire perimeter of the cut or only at a small number of discrete points around the perimeter.

Cutout hole 16 may be formed by simply cutting all the way through base board 12 and then removing the rectangular cutout piece. In alternative embodiments, cutout hole 16 may be formed from the outset, e.g., by injection molding base board 12 to include such a hole. Thus, cutout hole 16 need not be literally cut into base board 12.

Finally, at any point after the two sheets of EVA have been bonded together, the end portions of toe pieces 26 and straps 24 may be inserted through holes 25 and 72. Because holes 25 have been aligned with holes 72, the tabs 73 on such end portions preferably will seat within holes 72.

Each two-layer bonded sheet of EVA generally will be, capable of being cut into plural display panels 10. Such cuts typically can be made at the same time that the cuts are being made for each individual display panel 10.

As mentioned above, the foregoing embodiments are representative only. Different materials (e.g., polyvinyl chloride (PVC) and/or natural or synthetic leather or rubber) and/or different processes (e.g., stitching and/or injection molding) may instead be used, depending upon the shoes and other components to be formed from base board 12. However, most materials used for forming the soles for shoes can be obtained in sheet form, and therefore it often will be possible to use the above-described processes with little modification.

Figure 6:
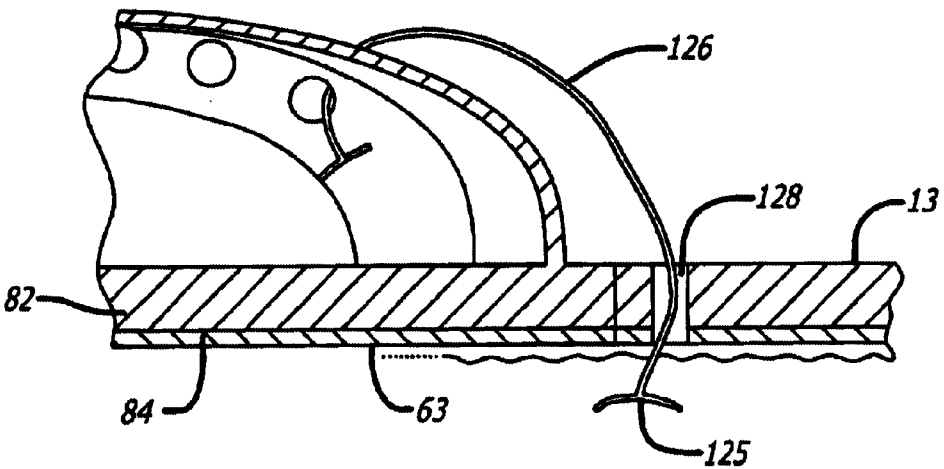
FIG. 6 illustrates a cross-sectional view of a shoe display panel according to the second representative embodiment of the invention.
Figure 5:
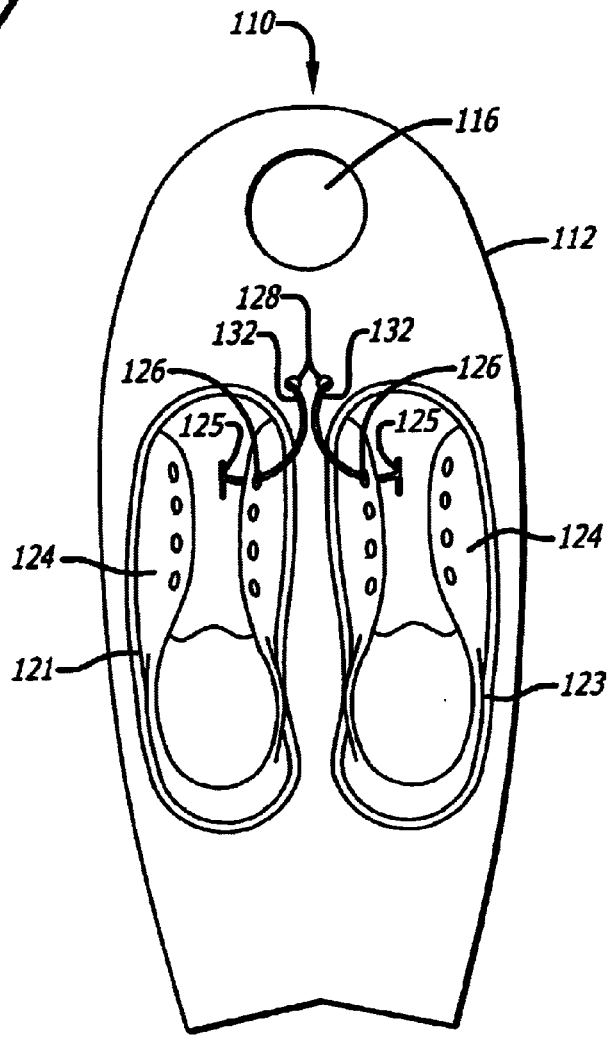
FIG. 5 illustrates a top plan view of a shoe display panel according to a second representative embodiment of the invention.

An alternative embodiment of a display panel 110 according to the present invention is illustrated in FIGS. 5 and 6. In the embodiment shown in FIGS. 5 and 6, base board 112 is shaped as a surf board, although any other novelty, geometric or other shape may instead be used. In addition, cutout hole 116, rather than being shaped rectangularly, is round in this embodiment. Still further, base board 112 does not include a cut between cutout hole 116 and the top of base board 112. Also, the upper portions 124 of the shoes in this embodiment of the invention enclose the wearer's foot, rather than the open sandal style of the previous embodiment. As a result, the sole cutout pieces 121 and 123, as well as the remainder of base board 112, preferably are made of a different material, such as synthetic rubber.

Lastly, rather than using a strap looped around the shoes and cutout hole 16, as shown in FIG. 1, two plastic straps 132, each having an enlarged tab 125 at each end, are used as the straps in this embodiment of the invention. Specifically, each of straps 132 is inserted at one end through a shoelace hole 126 in one of the shoes and at the other end through a hole 128 that has been punched through base board 112. The tabs 125 are larger than either shoelace hole 126 or base board hole 128, but are flexibly deformable so as to be capable of being inserted through either. Thus, once so inserted, tabs 125 prevent the shoes from being easily removed from base board 112.

In the foregoing embodiments, shoes are provided within cutout holes in a baseboard. In certain of the foregoing embodiments, additional items are provided with the shoes. Often such items will be novelty items, such as key chains, beverage coasters, frisbees, and similar types of items. These additional items often can make use of the excess base board material at little additional cost to the manufacturer.

As indicated above, one of the main advantages of the present invention is in connection with the display of shoes for retail sales purposes. For instance, by providing cutout holes 16 or 116, the display panel of the present invention can be hung from a display hook or rod. Using a sufficiently long rod, a number of such items can be hung from the same rod, one in front of the other, with the shoes on the frontmost display panel being the most visible to the consumer.

Figure 7:
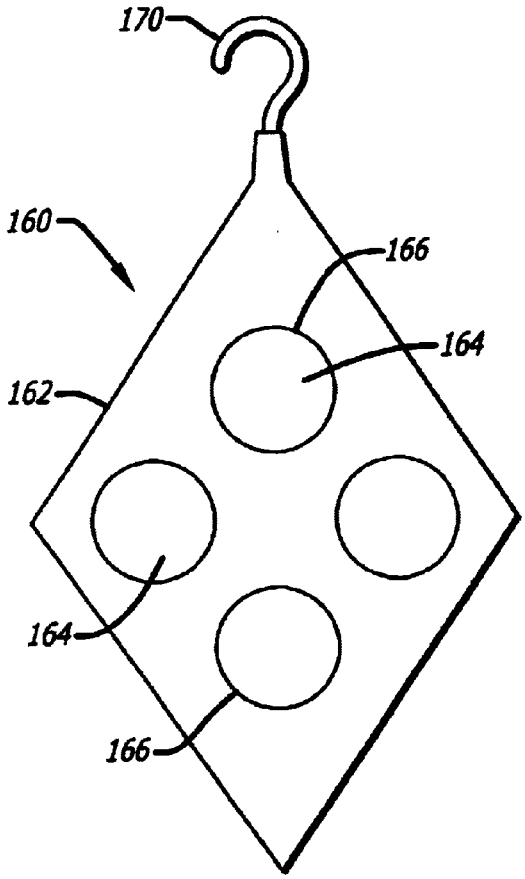
FIG. 7 illustrates a top plan view of a shoe display panel according to a third representative embodiment of the invention.

Thus, the foregoing embodiments of the present invention are primarily concerned with the display and promotion of shoes. However, this same concept can be extended to the promotion of other types of items as well. Specifically, any of a number of different items can be displayed as pop-out items in a similar base board. One embodiment of this is shown in FIG. 7, which illustrates a diamond-shaped display panel 160 that includes a base board 162 and a number of pop-out beverage coasters 164. The circular cuts 166 that are made to form the coasters 164 may be made in any manner described above.

Also, in this embodiment, rather than using a cutout hole for hanging the display panel, an open hook 170 is provided for this purpose. Hook 170 may be an integral part of base board 162 and formed in the same manner as the rest of base board 162, e.g., by cutting the entire outline for base board 162 (including hook 170) from a larger sheet (or sheets, if multiple layers are to be used) of material. Alternatively, hook 170 may be made of a different material than base board 162 and/or separately attached to base board 162, such as by gluing, clamping, or riveting hook 170 to base board 162.

Other variations are also possible on the above-described embodiments of the present invention. For instance, rather than simply cutting the shoe soles or other items from the base board and then leaving those items in the base board from which they were cut, it is also possible to mix and match. In this alternative embodiment, the applicable cuts are made all the way through the subject base board. Then, the cutout pieces are removed and inserted into identically sized and shaped cutout holes from a different base board.

In one example, identically sized and shaped shoe soles are cut from one blue base board and one green base board. The corresponding shoes are then swapped with their respective base boards. As a result, shoes with blue soles can be displayed in a green background base board and, vice versa, shoes with green soles can be displayed in a blue background base board.

It is noted that using different colors is just one example of swapping base boards having different aesthetic designs. In addition or instead, such swapping can be done with base boards having any other type of different aesthetic design (e.g., different impressed and/or painted-on patterns) and/or with base boards formed from different materials. Similarly, such swapping is not limited to only two base boards having different aesthetic designs or materials, but can be done with any number of different base boards.

Also, other variations on the above embodiments are possible. For instance rather than aligning the shoes with the center line of the base board, as shown in the attached figures, the shoe sole cutouts may be angled relative to the center line of the corresponding base board.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

Also, several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

What is claimed is:

1. A display panel with attached shoes, said display panel comprising:

(a) a base board defined by a first side, a second side and a peripheral edge, said base board having:
a first cut in a shape of a sole of a left shoe; and
a second cut in a shape of a sole of a right shoe;

(b) a left shoe having a sole matching the first cut, such that the sole of the left shoe fits snugly within the first cut;

(c ) a right shoe having a sole matching the second cut, such that the sole of the right shoe fits snugly in the second cut;

(d) an upper portion of the left shoe attached to an area of the second side that is enclosed by the first cut; and (e) an upper portion of the right shoe attached to an area of the second side that is enclosed by the second cut.

2. A display panel according to claim 1, wherein the first cut does not fully penetrate the base board at all points around a perimeter of said first cut.

3. A display panel according to claim 1, wherein the baseboard includes a first layer comprised of a first material and a second layer comprised of a second material, wherein the first material is stronger than the second material, and wherein the second layer is disposed closer to the second side than is the first layer.

4. A display panel according to claim 3, wherein the second layer is thicker than the first layer.

5. A display panel according to claim 3, wherein the second side includes additional cuts that do not fully penetrate the base board.

6. A display panel according to claim 5, wherein said additional cuts penetrate the first layer but not the second layer.

7. A display panel according to claim 1, wherein the second side is smoother than the first side.

8. A display panel according to claim 1, further comprising a strap that attaches to a part of the base board that is outside of the first cut and the second cut and also attaches to at least one of: the upper portion of the left shoe and the upper portion of the right shoe.

9. A display panel according to claim 8, wherein the strap is comprised of at least one of string, plastic and a metal chain.

10. A display panel according to claim 8, wherein the strap attaches to the upper portion of the right shoe and to the upper portion of the left shoe.

11. A display panel according to claim 1, wherein the base board also includes a cutout hole near the peripheral edge.

12. A display panel according to claim 11, wherein the base board also includes a cut entirely through the base board and extending from the cutout hole to the peripheral edge.

13. A display panel according to claim 11, further comprising a strap that attaches to the base board by looping around a part of the base board that is between the cutout hole and the peripheral edge and that also attaches to at least one of: the upper portion of the left shoe and the upper portion of the right shoe.

14. A display panel according to claim 1, wherein the base board has approximately uniform thickness over its entire area.

15. A display panel according to claim 1, wherein the base board includes a hook.

16. A display panel according to claim 1, further comprising a hook attached to the base board.

17. A display panel with attached shoes, said display panel comprising:

(a) a base board defined by a first side, a second side and a peripheral edge, said base board having:
a first cutout hole in a shape of a sole of a left shoe; and
a second cutout hole in a shape of a sole of a right shoe;

(b) a left shoe having a sole matching the first cutout hole, such that the sole of the left shoe fits snugly within the first cutout hole;

(c) a right shoe having a sole matching the second cutout hole, such that the sole of the right shoe fits snugly within the second cutout hole;

(d) an upper portion of the left shoe attached to the sole of the left shoe; and (e) an upper portion of the right shoe attached to the sole of the right shoe;

wherein the sole of the left shoe has been cut from the base board to form the first cutout hole and the sole of the right shoe has been cut from the base board to form the second cutout hole.

18. A display panel according to claim 17, further comprising a strap that attaches to the base board and also attaches to at least one of the left shoe and the right shoe.

19. A display panel according to claim 18, wherein the strap is comprised of at least one of string, plastic and a metal chain.

20. A display panel according to claim 18, wherein the strap attaches to the left shoe and the right shoe.

21. A display panel according to claim 17, wherein the base board also includes a third cutout hole near the peripheral edge.

22. A display panel according to claim 21, wherein the base board also includes a cut extending from the third cutout hole to the peripheral edge.

23. A display panel with matching shoes, said display panel comprising:

(a) a base board defined by a first side, a second side and a peripheral edge, said base board having:
a first cutout hole in a shape of a sole of a left shoe;
a second cutout hole in a shape of a sole of a right shoe; and
a third cutout hole near the peripheral edge;

(b) a left shoe having a sole matching the first cutout hole, such that the sole of the left shoe fits snugly within the first cutout hole;

(c) a right shoe having a sole matching the second cutout hole, such that the sole of the right shoe fits snugly within the second cutout hole; and (d) a strap that attaches to the base board by looping around a part of the base board that is between the third cutout hole and the peripheral edge and also attaches to at least one of the left shoe and the right shoe.

24. A display panel according to claim 17, wherein at least one of the following conditions is satisfied: (1) the sole of the left shoe is bonded within the first cutout hole using adhesive material and (2) the sole of the right shoe is bonded within the second cutout hole using adhesive material.

25. A display panel according to claim 17, wherein at least one of the following conditions is satisfied: (1) the base board includes a hook and (2) a hook is attached to the base board.

26. A display panel with attached shoes, said display panel comprising:

(a) a base board defined by a first side, a second side and a peripheral edge, said base board having:
a first cutout hole in a shape of a sole of a left shoe; and
a second cutout hole in a shape of a sole of a right shoe;

(b) a left shoe having a sole matching the first cutout hole, such that the sole of the left shoe fits snugly within the first cutout hole;

(c) a right shoe having a sole matching the second cutout hole, such that the sole of the right shoe fits snugly within the second cutout hole;

(d) an upper portion of the left shoe attached to the sole of the left shoe; and (e) an upper portion of the right shoe attached to the sole of the right shoe;

wherein the base board, the sole of the left shoe, and the sole of the right shoe all comprise a same material.

27. A display panel according to claim 26, wherein the base board, the sole of the left shoe, and the sole of the right shoe all consist of a same material.

28. A display panel according to claim 26, wherein the base board has a first aesthetic design and each of the sole of the left shoe and the sole of the right shoe has a second aesthetic design, and wherein the first aesthetic design is different than the second aesthetic design.

29. A display panel according to claim 26, wherein the base board also includes a third cutout hole near the peripheral edge and a cut extending from the third cutout hole to the peripheral edge.

30. A display panel with attached shoes, said display panel comprising:

(a) a base board defined by a first side, a second side and a peripheral edge, said base board having:
a first cutout hole in a shape of a sole of a left shoe; and
a second cutout hole in a shape of a sole of a right shoe;

(b) a left shoe having a sole matching the first cutout hole, such that the sole of the left shoe fits snugly within the first cutout hole;

(c) a right shoe having, a sole matching the second cutout hole, such that the sole of the right shoe fits snugly within the second cutout hole;

(d) an upper portion of the left shoe attached to the sole of the left shoe; and (e) an upper portion of the right shoe attached to the sole of the right shoe;

wherein the first cutout hole and the second cutout hole extend completely through the base board.

31. A display panel according to claim 30, wherein the base board, the sole of the left shoe, and the sole of the right shoe all comprise a same material.

32. A display panel according to claim 31, wherein the base board, the sole of the left shoe, and the sole of the right shoe all consist of a same arrangement of material.

33. A display panel according to claim 30, wherein the base board has a first aesthetic design and each of the sole of the left shoe and the sole of the right shoe has a second aesthetic design, and wherein the first aesthetic design is different than the second aesthetic design.

34. A display panel according to claim 30, wherein the base board also includes a third cutout hole near the peripheral edge and a cut extending from the third cutout hole to the peripheral edge.

35. A display panel with attached shoes, said display panel comprising:

(a) a base board which is solid, has a uniform thickness and is defined by a first side, a second side and a peripheral edge, said base board having:
a first cutout hole in a shape of a sole of a left shoe; and a second cutout hole in a shape of a sole of a right shoe;

(b) a left shoe having a sole matching the first cutout hole, such that the sole of the left shoe fits snugly within the first cutout hole;

(c) a right shoe having a sole matching the second cutout hole, such that the sole of the right shoe fits snugly within the second cutout hole;

(d) an upper portion of the left shoe attached to the sole of the left shoe; and (e) an upper portion of the right shoe attached to the sole of the right shoe.

36. A display panel according to claim 35, wherein the base board, the sole of the left shoe, and the sole of the right shoe all comprise a same material.

37. A display panel according to claim 36, wherein the base board, the sole of the left shoe, and the sole of the right shoe all consist of a same material.

38. A display panel according to claim 35, wherein the base board has a first aesthetic design and each of the sole of the left shoe and the sole of the right shoe has a second aesthetic design, and wherein the first aesthetic design is different than the second aesthetic design.

39. A display panel according to claim 35, wherein the base board also includes a third cutout hole near the peripheral edge and a cut extending from the third cutout hole to the peripheral edge.

40. A display panel with attached shoes, said display panel comprising:

(a) a base board defined by a first side, a second side and a peripheral edge, said base board having:
a first cutout hole in a shape of a sole of a left shoe; and a second cutout hole in a shape of a sole of a right shoe;

(b) a left shoe having a sole matching the first cutout hole, such that the sole of the left shoe fits snugly within the first cutout hole;

(c) a right shoe having a sole matching the second cutout hole, such that the sole of the right shoe fits snugly within the second cutout hole;

(d) an upper portion of the left shoe attached to the sole of the left shoe; and (e) an upper portion of the right shoe attached to the sole of the right shoe;

wherein the base board, the sole of the left shoe and the sole of the right shoe have the same thickness.

41. A display panel according to claim 40, wherein the base board, the sole of the left shoe, and the sole of the right shoe all comprise a same material.

42. A display panel according to claim 41, wherein the base board, the sole of the left shoe, and the sole of the right shoe all consist of a same material.

43. A display panel according to claim 40, wherein the base board has a first aesthetic design and each of the sole of the left shoe and the sole of the right shoe has a second aesthetic design, and wherein the first aesthetic design is different than the second aesthetic design.

44. A display panel according to claim 40, wherein the base board also includes a third cutout hole near the peripheral edge and a cut extending from the third cutout hole to the peripheral edge.

45. A display panel with attached shoes, said display panel comprising:

(a) a base board comprised of plural bonded sheets of material and defined by a first side, a second side and a peripheral edge, said base board having:
a first cutout hole in a shape of a sole of a left shoe; and a second cutout hole in a shape of a sole of a right shoe;

(b) a left shoe having a sole matching the first cutout hole, such that the sole of the left shoe fits snugly within the first cutout hole;

(c) a right shoe having a sole matching the second cutout hole, such that the sole of the right shoe fits snugly within the second cutout hole;

(d) an upper portion of the left shoe attached to the sole of the left shoe; and (e) an upper portion of the right shoe attached to the sole of the right shoe.

* * * * *